US007235144B2

(12) United States Patent
Claus et al.

(10) Patent No.: US 7,235,144 B2
(45) Date of Patent: Jun. 26, 2007

(54) METHOD FOR THE FORMATION OF A HIGH-STRENGTH AND WEAR-RESISTANT COMPOSITE LAYER

(75) Inventors: Juergen Claus, Fellbach (DE); Reiner Heigel, Remseck (DE); Markus Kern, Teltow (DE)

(73) Assignee: DaimlerChrysler AG, Stuttgart (DE)

( * ) Notice: Subject to any disclaimer, the term of this patent is extended or adjusted under 35 U.S.C. 154(b) by 353 days.

(21) Appl. No.: 10/477,956

(22) PCT Filed: May 10, 2002

(86) PCT No.: PCT/EP02/05163

§ 371 (c)(1),
(2), (4) Date: Nov. 17, 2003

(87) PCT Pub. No.: WO02/095089

PCT Pub. Date: Nov. 28, 2002

(65) Prior Publication Data

US 2004/0146738 A1 Jul. 29, 2004

(30) Foreign Application Priority Data

May 18, 2001 (DE) ..... 101 24 250

(51) Int. Cl.
*C22F 1/04* (2006.01)

(52) U.S. Cl. ..... 148/535; 148/525; 148/903

(58) Field of Classification Search ..... 148/516, 148/525, 535, 537, 903
See application file for complete search history.

(56) References Cited

U.S. PATENT DOCUMENTS

| | | | | |
|---|---|---|---|---|
| 4,157,923 | A * | 6/1979 | Yen et al. | 148/512 |
| 4,732,778 | A | 3/1988 | Kawasaki | 427/53.1 |
| 4,746,540 | A * | 5/1988 | Kawasaki et al. | 427/597 |
| 5,104,748 | A * | 4/1992 | Mori et al. | 428/674 |
| 5,985,056 | A | 11/1999 | McCay et al. | 148/511 |

FOREIGN PATENT DOCUMENTS

| | | |
|---|---|---|
| DE | 31 14 701 | 10/1982 |
| DE | 4040436 | 6/1992 |
| EP | 02 21 276 | 5/1987 |
| EP | 0411322 | 2/1991 |
| GB | 1 574 984 | 9/1980 |
| WO | WO 97 26388 | 7/1997 |

OTHER PUBLICATIONS

Search Report of PCT/DE02/05163, no date.

* cited by examiner

*Primary Examiner*—Scott Kastler
(74) *Attorney, Agent, or Firm*—Davidson, Davidson & Kappel, LLC

(57) ABSTRACT

A process for forming a high-strength, wear-resistant composite layer on the surface of an aluminum alloy substrate from an applied additive material. The additive material consists of an alloy or powder mixture which contains aluminum, silicon and at least 15% by weight of iron. Irradiating the alloy powder or powder mixture which has been positioned on the surface of the aluminum alloy substrate using a laser melts together with the alloy or powder mixture and a superficial part of the aluminum alloy substrate.

13 Claims, 1 Drawing Sheet

METHOD FOR THE FORMATION OF A HIGH-STRENGTH AND WEAR-RESISTANT COMPOSITE LAYER

BACKGROUND

The invention relates to a process for forming a high-strength, wear-resistant composite layer on the surface of an aluminum alloy substrate.

For components made from Al—Si alloys, it is preferable to use hypereutectic alloys, since such alloys have proven particularly advantageous with regard to wear and minimization of friction. To obtain a sufficient number and size of the primary silicon crystals, the aluminum alloys contain, for example, 14 to 17% of silicon. In addition to aluminum, coarse silicon crystals are also formed in the alloy. Etching processes which reduce the thickness of the aluminum cause the wear-resistant, coarse silicon crystals to project, while the recessed aluminum makes it possible to build up a stable lubricating film.

A higher wear resistance in aluminum alloys can already be improved considerably by hardening by modification of the substrate surfaces, for example by partially melting the surface using a laser beam. The result is an increase in strength at the surface.

EP 0 411 322 has disclosed a process which is used to produce wear-resistant surfaces on components made from an Al—Si alloy. For this purpose, the surfaces are coated with a layer comprising a binder, pulverulent silicon, an inoculant for primary silicon crystals and a flux, and then this coating is melted by means of laser energy. The addition of hard materials, for example in the form of metal carbides or metal nitrides, already effects a considerable increase in the surface hardness. One simple method of applying the alloying elements is provided by the screen-printing technique.

Moreover, DE 40 40 436 has disclosed a process for producing wear-resistant layers on cylinder liners made from light metal alloys, in which the entire cylinder liner is subjected to a solid-liquid-solid phase transition by means of high-energy beams—laser or electron beams—and then mechanical remachining is carried out. To increase the surface hardness, the layers may be alloyed with small amounts of iron or nickel and provided with hard materials. The piston surfaces which are to be treated by way of example are in this case first of all electroplated with a selected metal in a first process step.

However, the alloying fractions used in the known processes are restricted to phases which do not achieve a satisfactory hardness. It would be desirable to further increase the resistance of the component surface to wear.

SUMMARY OF THE INVENTION

The invention is based on the object of providing a process which creates particularly wear-resistant surfaces.

The present invention provides a process for forming a high-strength, wear-resistant composite layer on a surface of an aluminum alloy substrate. The process includes the steps of: providing an additive material in one of an alloy and a powder mixture to the surface of an aluminum alloy substrate, the additive material including aluminum, silicon, at least 20% by weight of iron, and one of up to 15% by weight of copper and up to 5% by weight of zinc; irradiating the additive material on the substrate using a laser so as to create a melt of the additive material and of a surface part of the substrate; and solidifying the melt using high cooling rates in order to form a homogeneous microstructure.

The process for forming a high-strength, wear-resistant composite layer on the surface of an aluminum alloy substrate comprises positioning an additive material on the surface of the substrate. The additive material consists of an alloy or powder mixture which contains aluminum, silicon and at least 15% by weight of iron. Irradiating the alloy or powder mixture positioned or supplied on the surface of the aluminum alloy substrate with a laser causes the alloy or powder mixture and a superficial part of the aluminum alloy substrate to fuse together. To prevent oxidation of the surface during the melting and until cooling takes place, the process is preferably carried out under an inert atmosphere. The melt is solidified at high cooling rates in order to form a fine, homogenous microstructure.

Surprisingly, the process with rapid cooling from the molten phase causes far higher iron contents than has hitherto been known to be incorporated into thermally stable, wear-resistant intermetallic compounds.

The drawback of high cooling rates which is described in the prior art, namely that although laser melting gives a high grain fineness, insufficient primary silicon is formed, is hereby overcome. In this way, significantly longer service lives under wearing loads and also under thermomechanical loads are advantageously achieved.

Controlled guidance of the laser beam over the surface advantageously leads to hard composite layers with a finer microstructure being formed at locally delimited parts of the component, for example at the locations which are subject to particular thermal and mechanical loads.

The admixed iron from the alloy or powder mixture primarily forms binary intermetallic compounds with aluminum and ternary intermetallic compounds with aluminum and silicon. The iron content is preferably between 15 and 30% by weight. Within this range, a crack-free surface of the composite layer is still formed.

Silicon is also precipitated out of the melt in the composite layer to a certain extent as a result of using a hypereutectic Al—Si alloy. Increased precipitation of silicon can be further assisted by targeted introduction of suitable nucleating agents.

Moreover, it is advantageous to add copper and/or zinc and/or vanadium to the alloy or powder mixture in order to form further intermetallic compounds. The copper content is preferably between 0 and approximately 15% by weight, while the zinc content is preferably between 0 and approximately 5% by weight and the vanadium content is preferably between 0 and approximately 7% by weight. Additives of this type improve the quality of the entire composite layer in terms of the strength, toughness and resistance to corrosion.

It is particularly advantageous to admix hard ceramic materials as powders into the alloy or powder mixture. The hard ceramic materials consist of metal carbides or metal nitrides and preferably of SiC, WC, TiC or $Si_3N_4$. The content of the hard ceramic materials is between 0 and 50% by volume.

In the process according to the invention, the hard materials are superficially melted in the metal melt, resulting in a roughened surface of the powder particles, which combines in dentate form with the compact composite layer. This partial melting of the hard-material surface occurs in particular when relatively high iron contents are added.

A preferred composition of the wear-resistant composite layer on the surface of an aluminum alloy substrate contains an iron content of 15 to 30% by weight and preferably consists of binary aluminum-iron and ternary aluminum-silicon-iron phases.

BRIEF DESCRIPTION OF THE DRAWINGS

In the text which follows, the invention is explained in more detail on the basis of advantageous exemplary embodiments and with reference to diagrammatic drawings presented in the figures, in which.

DETAILED DESCRIPTION

Figure 1:
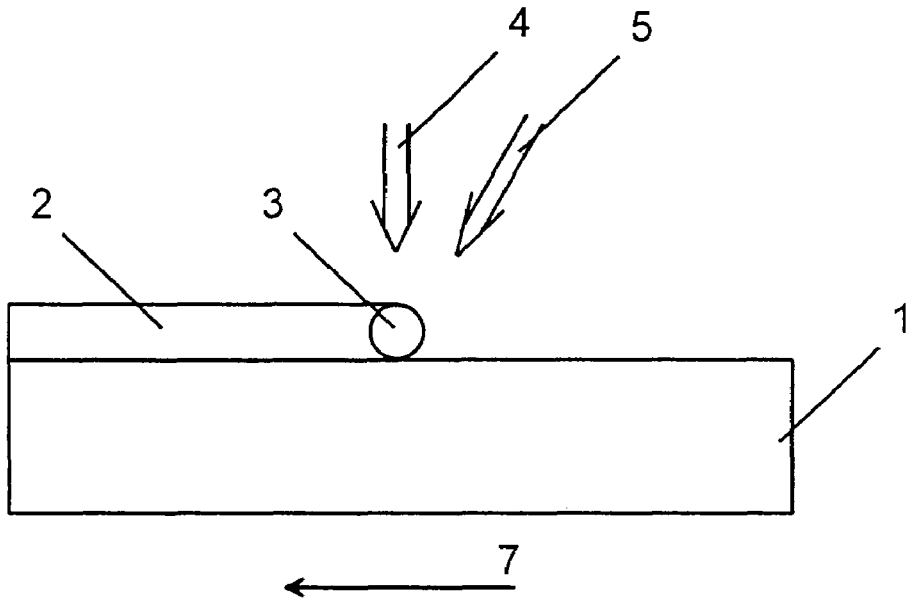
FIG. 1 shows a production process with the additive material being added continuously.

In a first exemplary embodiment, shown in FIG. 1, the production process is illustrated with the additive material being added continuously. For this purpose, the surface of an aluminum alloy substrate 1 is moved along beneath a laser beam 4. The movement 7 takes place at a speed of approximately 200 mm to 1 m per minute. The additive material 5 is supplied in the form of strips, wires or powder directly at the point of incidence of the laser beam and is melted to form a molten pool 3. In this procedure, the composite layer 2 is formed precisely at the points of incidence of the laser; at the points of incidence, the beam has an approximate diameter of 3 to 8 mm.

This method is particularly suitable for local layer formation, eliminating any further structuring of the surface. The addition of powder mixtures can take place without further binder materials by means of a spray process.

The solidification of the melt with high cooling rates to form a fine, homogenous microstructure may also be effected via additional cooling of the substrate surface or of the entire substrate material.

Figure 2:
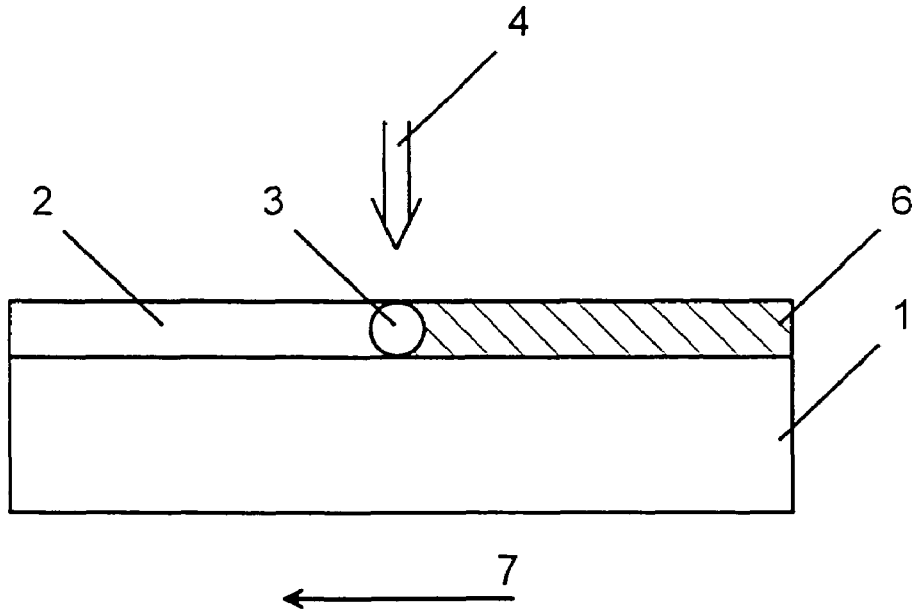
FIG. 2 shows a production process with the additive material applied in advance.

In a second exemplary embodiment, shown in FIG. 2, the additive material has already been applied to the surface 6 before any melting takes place. In the case of large-area composite layers, it is preferable for the material to be applied by covering the substrate surface with strips and plates. Locally applied composite layers are formed by prior structuring of the surface, for example by screen printing, using additive materials in powder form.

What is claimed is:

1. A process for forming a high-strength, wear-resistant composite layer on a surface of an aluminum alloy substrate, the process comprising:

providing an additive material in one of an alloy and a powder mixture to the surface of an aluminum alloy substrate, the additive material including aluminum, silicon, at least 20% by weight of iron, and one of up to 15% by weight of copper and up to 5% by weight of zinc;

irradiating the additive material on the substrate using a laser so as to create a melt of the additive material and of a surface part of the substrate; and solidifying the melt using high cooling rates in order to form a homogeneous microstructure.

2. The process as recited in claim 1, wherein during at least one of the irradiating and solidifying steps the iron of the additive material forms intermetallic compounds with at least the aluminum of the substrate.

3. The process as recited in claim 2, wherein the iron forms the intermetallic compounds with the aluminum of the substrate and with the silicon of the additive material.

4. The process as recited in claim 1, wherein the additive material includes between 20% and 30% by weight of iron.

5. The process as recited in claim 1, further comprising precipitating out at least a portion of the silicon from the melt.

6. The process as recited in claim 5, wherein the aluminum alloy substrate includes a hypereutectic Al—Si alloy.

7. The process as recited in claim 1, wherein the additive material includes vanadium and wherein the vanadium forms further intermetallic compounds.

8. The process as recited in claim 7, wherein the additive includes up to 7% by weight of the vanadium.

9. The process as recited in claim 1, wherein the additive material includes ceramic materials in powder form.

10. The process as recited in claim 9, wherein the ceramic materials includes at least one of metal carbides and metal nitrides.

11. The process as recited in claim 10, wherein the ceramic materials further include at least on of SiC, WC, TiC, and $Si_3N_4$.

12. The process as recited in claim 9, wherein the additive material includes up to 50% by volume of the ceramic materials.

13. The process as recited in claim 9, wherein the irradiating includes superficially melting the ceramic materials in the melt, and wherein the ceramic materials combine in dentate form with metal fractions of the composite layer.

* * * * *

UNITED STATES PATENT AND TRADEMARK OFFICE

CERTIFICATE OF CORRECTION

PATENT NO. : 7,235,144 B2
APPLICATION NO. : 10/477956
DATED : June 26, 2006
INVENTOR(S) : Juergen Claus, Reiner Heigl and Markus Kern It is certified that error appears in the above-identified patent and that said Letters Patent is hereby corrected as shown below:

Title Pg, Item
"(75) Inventors", the second inventor's name should read --Reiner HEIGL-- instead of "Reiner HEIGEL."

Signed and Sealed this

Thirteenth Day of November, 2007

JON W. DUDAS
*Director of the United States Patent and Trademark Office*

UNITED STATES PATENT AND TRADEMARK OFFICE

CERTIFICATE OF CORRECTION

PATENT NO. : 7,235,144 B2
APPLICATION NO. : 10/477956
DATED : June 26, 2007
INVENTOR(S) : Juergen Claus, Reiner Heigl and Markus Kern It is certified that error appears in the above-identified patent and that said Letters Patent is hereby corrected as shown below:

Title Pg, Item
"(75) Inventors", the second inventor's name should read --Reiner HEIGL-- instead of "Reiner HEIGEL."

This certificate supersedes Certificate of Correction issued November 13, 2007.

Signed and Sealed this

Eighteenth Day of December, 2007

JON W. DUDAS
*Director of the United States Patent and Trademark Office*